US005299815A

United States Patent [19]

Brosnan et al.

[11] Patent Number: 5,299,815

[45] Date of Patent: Apr. 5, 1994

[54] ROLLER SKATE BRAKING DEVICE

[76] Inventors: Kelly M. Brosnan, 3030 Regent St. #17; Paul S. Turin, 2418 Grant St., both of Berkeley, Calif. 94703; Robert G. Ullrich, 2262 Clinton Ave., Alameda, Calif. 94501; Robert D. Wilkes, Jr., 2420 Grant St., Berkeley, Calif. 94703

[21] Appl. No.: 839,543

[22] Filed: Feb. 18, 1992

[51] Int. Cl.[5] ..... A63C 17/14

[52] U.S. Cl. ..... 280/11.2; 188/5

[58] Field of Search ..... 280/11.2; 188/5, 25

[56] References Cited

U.S. PATENT DOCUMENTS

| | | | |
|---|---|---|---|
| 225,361 | 3/1880 | French . | |
| 2,872,201 | 2/1959 | Wagers et al. . | |
| 4,099,734 | 7/1978 | Lowery . | |
| 4,167,225 | 9/1979 | Fragoso . | |
| 4,295,547 | 10/1981 | Dungan . | |
| 4,453,726 | 6/1984 | Ziegler . | |
| 4,807,893 | 2/1989 | Huang . | |
| 4,817,974 | 4/1989 | Bergeron . | |
| 4,838,564 | 6/1989 | Jarvia . | |
| 4,892,332 | 1/1990 | Jennings . | |
| 4,909,523 | 3/1990 | Olson . | |
| 4,943,072 | 7/1990 | Henig . | |
| 4,943,075 | 7/1990 | Henig . | |
| 5,028,058 | 7/1991 | Olson . | |
| 5,048,848 | 9/1991 | Olson . | |
| 5,088,748 | 2/1992 | Koselka et al. . | |
| 5,118,122 | 6/1992 | Ricart | 280/11.2 |
| 5,183,275 | 2/1993 | Hoskin | 280/11.2 |

FOREIGN PATENT DOCUMENTS 0379906 12/1990 Italy .

*Primary Examiner*—Joseph D. Pape

*Attorney, Agent, or Firm*—Heller, Ehrman, White & McAuliffe

[57] ABSTRACT

A braking system is disclosed for foot-bound roller skates, particularly in-line roller skates, consisting of a method and apparatus for activating the brake, continuously applying braking force while the brake is activated without the application of force to the activating apparatus, and stowing the brake. Preferably, the brake deploys to serve as the aft point on which the skate rides, along with one or more forward wheels.

19 Claims, 11 Drawing Sheets

ROLLER SKATE BRAKING DEVICE

FIELD OF THE INVENTION

This invention relates to brakes for small, footbound vehicles, including roller skates, roller skis and the like. It has particular application in in-line roller skates.

BACKGROUND OF THE INVENTION

Traditional roller skates consist of a platform to which are appended four wheels, paired in two axles fore and aft. This arrangement provides lateral stability and braking is normally accomplished by turning the feet to have forward momentum dissipated by increased frictional forces between wheels and the surface being traversed. Supplemental braking means usually are not required because high speeds are not attained with traditional roller skates. As materials improve, particularly in wheels, there is a need for supplemental braking means, even in traditional roller skates. Presently, the means of choice is a toe-mounted friction pad, which the skater engages by raising one or both heels.

However, the need for satisfactory braking means is far greater in in-line roller skates because much higher velocity can be attained. In-line roller skates use two or more, typically four, wheels aligned in a common vertical plane. This arrangement gives the skater a feel and movement more resembling ice skates than traditional roller skates. Thus, the lateral stability is reduced, and at the same time higher speeds can be attained. Unlike ice skates, however, the wheels in in-line roller skates cannot be slid laterally over the skating surface for a high-friction, quick stop.

In-line skates have been part of the art since at least 1876 (U.S. Pat. No. 7,345). Currently, the designs of U.S. Pat. Nos. 3,287,023 and 4,909,523 are durable, cost effective, and functional for the thrill of high-speed movement, notwithstanding a lack of acceptable braking Lateral instability and high speed result in danger of bodily harm far greater than with traditional roller skates The problem is compounded by the fact that high speeds can usually be attained in roadway environments where motion vehicles and pedestrians are encountered.

1991 estimates indicate that there are 5 to 6 million in-line roller skaters in the United States, with sales of three million units per year and about 75% annual growth. Presently, the industry standard braking means is a simple stub aft of the rear-most wheel. The stub has a static friction pad, which engages the skating surface when the skater raises his toe and extends leg forward. The stub is inadequate for safe, controlled braking. Media attention has been directed to the inability of present brakes and the high frequency of skater injuries. Where a panic stop is required, the stub is incapable, and the only recourse is for the skater to drop to the road surface and rely on the friction between his body and the road to stop and avoid collision. The stub is so inadequate, skaters frequently remove the factory supplied braking device.

The severe problem of speed control has attracted a great deal of unfavorable attention beyond that of actual product users. A growing number of city governments across the country have banned the use of in-line skating because of the high degree of injury and the conspicuous uncontrollability exhibited by skaters—factors directly related to the ineffectiveness of current braking means. The high degree of uncontrollability and resultant injuries coupled with a broad publication of the situation has created a large and growing liability exposure to in-line skate producers as well as contributing negatively to the general image of the sport. It has been conveyed to the inventors without exception by the major manufacturers that a solution to the braking problem is the preeminent design necessity facing the industry. Furthermore, that such a solution is required to the long-term health of the sport, and that such a solution would constitute a profound competitive advantage.

DESCRIPTION OF THE PRIOR ART

The art has tried a variety of techniques to enable in-line roller skaters to stop:

1. TOE STOP

Initially, the braking means of choice for in-line skates was directly borrowed from the art employed on "truck" design standard skates. This consisted of a static friction pad of rubber or similar material, front mounted before the forward most wheel of the skate upon the chassis. This configuration proved to be ineffective for several reasons: The amount of actual force one was able to apply to the friction surface was greatly limited due to the difficult and awkward physical posture required to engage the pad to the road surface. Also the front mount aspect of the placement made it extremely unstable laterally, further limiting the ability to apply necessary braking pressures, and also creating a severe lateral torque to various portions of the user's leg and exposing one to the injuries associated with high force twisting motions upon the leg.

2. HEEL STOP

The insufficient generation of braking force, instability and high potential for injury with the toe mounted configuration gave rise to a repositioning of the static friction pad at the rear of the skate, directly behind the rear most wheel. This configuration is without exception the current industry standard, utilized on every set of in-line skates from entry level to professional class. The benefits of the heel pad configuration are slight and only positive when viewed relative to the predecessor, allowing for relative improvement in stability over the toe mount pads and some relief to the tendency of a torquing injury to the knee or ankle joints. An increase in any braking force, however, is nominal at best and achieved generally via relative improvement in an ability to apply force without the skate body veering off to a side due to the previously noted lateral instabilities. Use of the heel stop in itself requires a significant skill level. Generally, novice skaters have great difficulty with the impairment of balance occurring during heel stop braking.

It is important to recognize that the roadway environment in which in-line skates are predominantly utilized necessitates a critically higher degree of effective velocity control to avoid harmful and even life threatening obstacles. The small improvements afforded by the heel mount system do not meet this greater hazard for essentially the same reasons as the abandoned toe mount system. The amount of braking force one is able to generate upon the friction surface is severely limited by the very physics necessary for activation. In order to activate the brake pad, the brake adorned boot is extended forward and the toe rotated upward about the ankle joint with the heel pad contacting the road surface. The actual physical posture required in activation is difficult to accomplish with genuine stability, and by definition limits the application of the skater's direct weight as a force to act upon the friction surface. Instead, the activation and sustainment of the braking is dependent upon the weak muscles comprising the frontal calf portion of the leg. This muscular weakness prevents an adequate application of force to the pad required for satisfactory braking, and allows for rapid onset of muscular fatigue and even cramping under high pressure or sustained activation of the brake. Additionally, the dynamics of posture and physical friction characteristics combine to substantially prevent accomplishment of desirable directional control while engaged in the braking posture. Each of these factors of inefficiency are greatly intensified in a graded surface environment in which even low velocities are far in excess of the current brakes' generated force capacity to effectively reduce speed—a fact that largely prohibits skating on hills and other inclined surfaces for all but the most expert skaters.

Finally, a significant problem with the heel stop is that as the pad wears, the angle between the foot and the surface being traversed must increase to make contact between the braking surface and the road surface. The already awkward braking movement becomes more awkward and unstable. To increase the angle, the skater moves the braking foot forward. As the brake wears, the braking foot extends further in front of the skater, increasing the risk of falling. The muscular fatigue problems gets worse as the brake wears.

Removal of these brakes from the skate rack is quite common due to their widely perceived inability to operate effectively. To compensate for the failure of the current art heel mount pad, at least two distinct technical methods for braking and velocity control have been created.

3. T-STOP

The first method is referred to as the "T-stop," which basically consists of dragging the wheels of one skate behind the other perpendicular to the other forward pointing skate and applying as much downward pressure as possible upon the perpendicular skate and through friction generated by the wheels affecting a drag to forward progress Once again, there exists a serious deficit in the availability of effective force directed to the friction surfaces due to inherent physiological limitations of the body in given postures. The friction wearing surface in this technique being the wheels themselves introduces a significant additional economic negativity due to the high cost of wheels and bearings and the excessive wear and deformation accrued thereupon in the application of the "T-stop" technique. The difficult postures required in this technique make directional control difficult and expose the skeleton to torquing injuries as well.

4. PIROUETTE

A second technique devised and sometimes employed in the absence of an effective braking means consists of dissipating forward momentum by entering into a spiralling directional path as tightly as possible and thus affecting via a pirouette a complete stop. While this can be an effective means for stopping forward progress in some situations, several factors make it generally inappropriate as an effective means for controlling speed. This technique requires a very high level of skill to accomplish. It also requires a relatively large physical area to accomplish and is thus largely inappropriate for use in the confines of traffic or in the vicinity of pedestrians. It can only be utilized at relatively low speeds. Finally, it does not allow for gradations of speed modulation, but rather accomplishes only full stopping.

5. REMOTE ACTIVATION

U.S. Pat. No. 4,943,075 discloses a means for velocity control by a remote, hand-activated, wheel mounted caliper device. Even if the remote activated caliper were adapted for in-line skate use, it would still face two serious obstacles:

A remote, hand activated braking means requires either awkward access to the handle lever or the undesirable necessity of maintaining it constantly in grip. Moreover, it is difficult to transmit the hand generated forces to the wheels. The potential for hand fatigue and the difficulty in the modulation of applied forces make such braking impractical. There is the possibility that objects will become entangled in cables risking injury. The cables interfere with normal skating motions. There is additional weight, expense and complexity with this remote caliper means. Perhaps most importantly, such a system could be activated without a mandatory assumption of a "stabilization posture" whereby application of the brake would disturb the equilibrium balance of the skater and cause him to pitch forward and fall.

The utilization of the skates' wheels as the friction means in a braking configuration poses several problems related to heat build up in the wheels due to friction. The standard wheel material for all in-line skates on the market is polyurethane, which is extremely poor at heat dissipation and tends to soften and delaminate from wheel hub cores. Excessive wheel wear will require frequent replacement, either because of heat or because of flat spots where the non-rotating, braked wheel erodes against the pavement surface.

6. PIVOTED WHEEL ACTING LEVER

European patent application 90100567.8 discloses an apparatus consisting of an operating arm pushing a friction member onto the direct contact surface of the skate wheel(s). The suggested means by which the activation is attained is expressed in at least two embodiments. The first requires the skater to either (1) reach down to the heel portion of the skate rack with his hand and apply pressure to the lever arm transferring force into the wheel(s), or (2) raise one foot off the ground to apply a downward pressure on the lever arm with the use of a portion of the non-braking skate. Each of these methods introduce very serious detriments to a skater's ability to remain balanced and thus avoid falling during activation. The hand activated scenario requires one to stoop down to a very awkward and difficult to maintain position in which the levered arm is reachable, and then apply substantial downward pressure. In the described posture, it would be very difficult to effectively brake and even small movements can cause the skater to fall. The other activation suggestion of using one lifted foot to activate the heel lever arm on the other skate would be so extremely difficult to accomplish, given the center of gravity and equilibrium dynamics of in-line skating, as to be hazardous.

The second embodiment uses a heel friction pad aft of the rearward wheel, mounted with a pivoting arm that concurrently moves a friction member into the rearmost wheel of the skate. This configuration is generally beset with the problems alluded to in the static heel pad discussion above with some nominal possible increase in braking forces generated in the rear wheel. Those forces as applied to the rear most wheel, however, would, in the likely event of wheel skidding, create a substantial instability in the tracking of the skate under activation and contribute to increasing the undesirable and injury threatening lateral torquing forces discussed previously.

The suggested specific means for applying friction to the wheels directly as prescribed on this disclosure would further suffer from a problem of affecting a continuous mating of the friction surface to the wheels due to the fact that wheel profiles undergo constant and greatly varying change in the course of normal skating depending on pavement surfaces, individual skating style, etc. True mating of contact surfaces would thus be difficult to achieve and further negatively limit the braking ability of applied forces.

In general, systems proposed which utilize a remotely activated means for brake deployment, defined as a deployment means not accomplished by motions of the foot and leg already common to the postures associated with normal skating, demonstrate some of the following negative factors:

a) instability associated with activation which adds to the basic instability of skaters due to a high center of gravity.

b) the lack of a mandatory assumption of a "stabilization posture" to preclude the high potential of an operator activating brakes without sufficient stabilization to avoid a forward pitch and fall.

c) awkwardness in accessing levers, handles, etc. to effect the activation of the brake or the awkwardness of having to keep such an activation means constantly in grip.

d) the danger associated with the potential to drop such an active means in a crucial situation and the inability therefore to affect braking activations.

e) the danger associated with the possibility of having the activation means of the apparatus, in the case of wires and the like, becoming encumbered upon vehicles, pedestrians of other objects that would promote collision.

f) the negative aesthetic of such a means within an extremely appearance conscious marketplace g) an introduced risk of mechanical or other apparatus failure due to the necessity of increased complexity of parts.

h) a negative cost effect upon the product utilizing a relatively complex, multi-faceted means due to an increase in fabrication and manufacturing expense.

i) a potential to increasing weight to a product that is human powered and sensitive to drag associated with additional weight.

Further, braking systems which act directly upon the wheel(s) of the skate are subject to some of the following problems:

a) limited amount of surface area available especially in the likelihood that only one or two wheel-acting would be feasible due to complexity of design, weight, and economic factors.

b) heat build up and resultant deformation and possible core delamination experienced when friction is applied to a poor heat conducting material like polyurethane, the industry standard material for all wheel products.

c) the economic disadvantage due to increased wear upon the wheels and the resultant need to replace wheels with greater frequency or replacement due to heat driven wheel deformation and failure.

d) the accumulation of flat spots upon the perimeter of the braking wheels due to skidding of the wheels under high pressure braking force applications and resultant lack of a smooth, efficient rolling surface.

e) erosion of the actual wheel road surface contact plane due to the ablation and change in size of the wheel diameter occurring relative to the non-braking wheels.

f) complexity in effecting a wheel activated brake and the undesirable consequence of high cost, potential to failure, and excessive weight.

g) the potential necessity of wheel redesign to accommodate some of the above mentioned factors and the costs and difficulties pertinent thereto.

SUMMARY OF THE INVENTION AND OBJECTS

The present invention provides means to deploy a brake behind the rear wheel(s) of the skate whereby a substantial amount of the skaters body weight is applied to braking.

Accordingly, it is an object of the present invention:

1) To provide a braking means for in-line skates and the like which allows for a large increase in available braking force directed by a skater to a friction means in contact with the road surface.

2) To utilize the large potential forces in one's body weight to accomplish this increase in applied braking forces.

3) To provide a means via the above description that greatly improves a skater's ability to stop in such a way as to avoid collision with vehicles, pedestrians and other potentially dangerous objects common to the normal skating environment.

4) To provide a means for braking that allows a more confident negotiation of hills and other inclines common to the skating environment.

5) To provide a greatly increased degree of stability for the skater during actual activation and utilization of the braking device.

6) To provide a device that substantially mitigates straining and potentially injurious torquing forces commonly experienced with the current art heel stop and "T-stop" braking technique.

7) To provide via improved stability and applied breaking forces a new method for quick stopping of the skater whereby, during actuation of the braking means one can effect a short turning radius skid similar to a "hockey stop" or lateral slide common to snow skiing.

8) To provide a braking means allowing confident and easy modulation of applied braking force by shifting body weight to or from the skate under braking forces.

9) To provide a braking means which allow stable directional changes while braking forces are activated.

10) To provide a braking means that has a self-righting directional action further contributing to stability and directional control.

11) To provide a braking means which requires a "stabilization posture" to activate ensuring a mitigation of crash promoting destabilizing forces encountered during decelerations.

12) To provide a braking means which is activated in such a way as to avoid the aforementioned difficulties with remote activated systems.

13) To provide a braking means which is activated by motions and skills of the foot and leg already common to in-line skate users in activating the current heel stop, and thus effecting a simple transition for utilization of the new device.

14) To provide a braking means that simultaneously benefits novice and intermediate users due to enhanced momentum control abilities and allows advanced level skaters access to regions such as inclines which previously were dangerous because of prior arts' ineffectiveness upon inclines.

15) To provide a braking means which accomplishes friction and stopping power without acting upon the wheels of the skate and thereby obviates incurring problems previously mentioned.

16) To provide a braking means which incorporates a friction material that is inexpensive, effective and easily replaceable.

17) To provide a braking means whose fabrication is simple and inexpensive so as to be a viable replacement option for the industry standard heel stop.

18) To provide braking means which allows easy usage and easy ability to safely replace worn parts such as friction pads.

19) To provide a braking means with a favorable aesthetic appearance greatly appreciated by sports product consumers.

20) To provide a braking means were pad wear does not negatively affect a physical ability to activate and sustain force application to the brake as in current art heel pad.

21) To provide a braking means where a worn friction pad in need of replacement and no longer piercing the surface plane safely can still function in the same way as a heel stop of the prior art.

22) To provide a braking means which allows the stopping dynamics of the current art heel stop in the case of activation/deployment failure.

23) To provide a brake integrated means which alleviates the precarious rolling motion of the sake when one is "walking" with them on or maneuvering in close quarters.

24) To provide a braking means such that normal wear from use of the device does not adversely affect the use of the brake nor reduce the braking force.

These and other objects will be apparent from the following detailed description of the drawings.

DRAWINGS

DETAILED DESCRIPTION

Figure 1A:
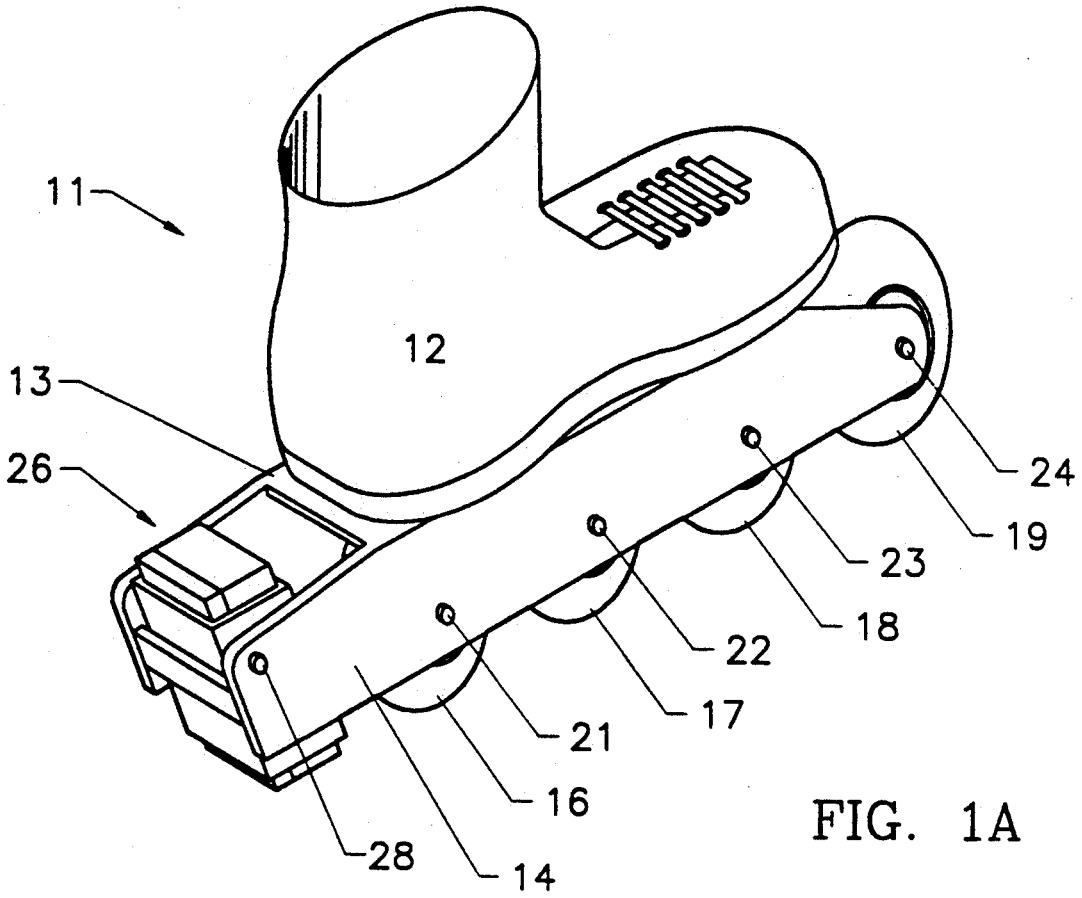
FIG. 1A is an isometric view of the skate with the "door-stop" embodiment of the invention.

The present invention incorporates mechanical means to deploy a friction surface below the rearmost wheel of the skate. When braking is not desired, the friction surface is returned to its stowed position, ready for the next braking. The several preferred embodiments are shown in the attached drawings Referring to FIG. 1A, the basic lever embodiment is shown. Skate 11 may include a boot 12 or may merely be a platform 13 for attachment to boot 12. In either case, dependent from platform 13 is wheel rack 14. In the embodiment shown, wheel rack 14 is for in-line wheels, although it may readily be adapted to carry the truck wheel arrangement of traditional roller skates. Wheel rack 14 is a channel bearing a series of wheels 16, 17, 18 and 19. More or fewer wheels may be appended to wheel rack 14, as desired. The wheels 16–19 are rotatably mounted on wheel rack 14 by any suitable means, such as axles 21, 22, 23, and 24, respectively, support on either side of each wheel by rack 14. Each wheel 16–19 includes a roller surface, such as polyurethane, mounted on a wheel.

Figure 1B:
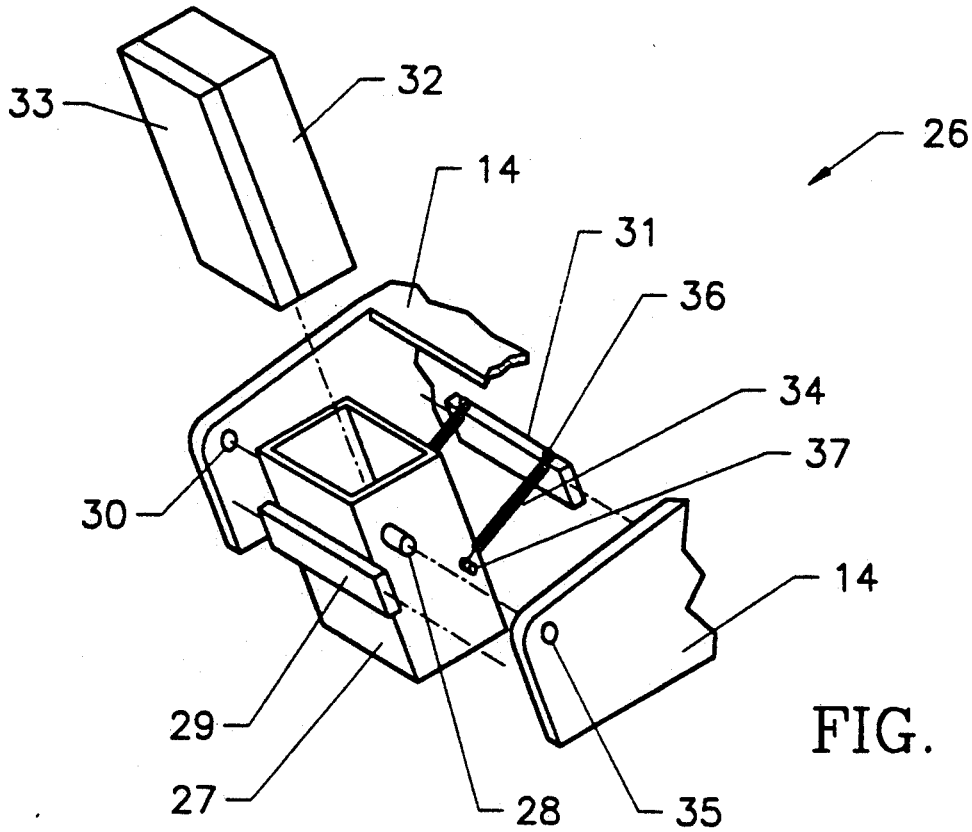
FIG. 1B is an exploded view of the brake assembly portion of the state of FIG. 1A.

According to the present invention, a brake assembly 26 is mounted aft of the rearmost wheel(s) in order to transmit body weight most easily to the brake, allow maximum control for the skater, and minimize foot rotation in a vertical plane about the skater's ankle. While other locations for brake assembly 26 may be used, by far the preferred location is aft of the rear wheel, particularly with in-line roller skates. The skater's weight is preferably between the front wheel 19 and brake assembly 26. In FIG. 1B, brake assembly 26 consists of a lever 27 rotatable about pivot 28 in an arcuate range between stop bars 29 and 31. Pivot 28 is mounted on wheel rack 14 at holes 30 and 35, to permit rotation in a vertical plane. Stops 29 and 31 are fixedly mounted on wheel rack 14 to limit the movement of lever 27 between a stowed position at stop 31 and a fully deployed position against stop 29. Lever 27 operates somewhat like a doorstop in swinging between a stowed position against stop 31 and a deployed position against stop 29.

Lever 27 is preferably plastic or other suitable material to which is bonded a friction block 32 made of an ablating material such as polyurethane for braking against a road surface. Block 32 has, either as a molded appendage or bonded thereto an activation surface 33 which serves to initiate the deployment of brake assembly 26. Tension spring 34 is secured to stop bar 31 at one end at 36. The other end of spring 34 is attached to lever 27 at point 37. Thus, spring 34 holds lever 27 in the stowed position against stop bar 31 when braking is not needed.

In operation of the embodiment of FIG. 1, brake assembly 26 is deployed by the skater raising his toe so that wheels 17, 18 and 19 are off the ground, and only wheel 16 continues to engage the road surface. Activation surface 33 touches the road surface when the skater's foot is rotated upwardly about the ankle in a vertical plane a suitable amount, such as at an angle of 5 degrees to 15 degrees between platform 13 and the road. Once activation surface 33 contacts the road surface, lever 27 is rotated about pivot 28 until it reaches stop bar 29, at which point friction block 32 is in full contact with the road surface. The contact with the road surface continues until the brake is stowed, and the skater's toe need not continue to be raised once the brake is triggered by the contact of activation surface 33 to the surface being traversed and the brake is deployed. Wheels 16, 17 and 18 remain off the ground, and only wheel 19 and friction surface 32 support the skater's foot. As the skater shifts his weight to the skate with the brake deployed, friction increases and forward movement is slowed. Lever 27 and friction surface 32 have a length sufficient to raise wheel rack 14 and appended wheels 16–18 above the road surface to maximize friction. Unlike currently used braking systems, the present invention permits substantially all of the body weight of the skater to be applied to braking, if necessary. Importantly, the skater does not need to apply force to the activation means to continue braking. Rather, the brake continues to function, once deployed, until it is again stowed, without any continuing force on the activation means. Prior art devices, such as those applying force to pads, wheels or axles, require squeezing or other application of force to the activation means for the duration of the period the skater wants to brake.

Once the skater's velocity has been modulated to the desired extent, the brake 26 may be released and restowed. To do so, the skater lifts his heel sufficiently to raise friction surface 32 from the surface being traversed. This permits spring 34 to rotate lever 27 in a counterclockwise direction about pivot 28 to return to the stowed position against stop bar 31 shown in FIG. 1.

Lever 27 may be made of tubular material with friction material 32 within the tube, much like an eraser that may be extended beyond the end of a tube as wear occurs. Friction material 32 may be maintained at the desired location to ensure that wheels 16–18 are off the ground by any suitable means. These include a collar (not shown) where tapered fingers held by a sliding ring grasp the renewable friction material 32 in the same manner as the eraser in a mechanical pencil. Alternatively, friction material 32 can be adjustably maintained at the proper level by a threaded rod arrangement like a self-adjusting drum brake (not shown).

Activation surface 33 may be of the same or different material as friction block 32. In the preferred embodiment, activation surface 33 is also of polyurethane material, but of a coefficient of friction that grips the road surface, whereas friction block 32 better sustains abrasion.

Figure 1C:
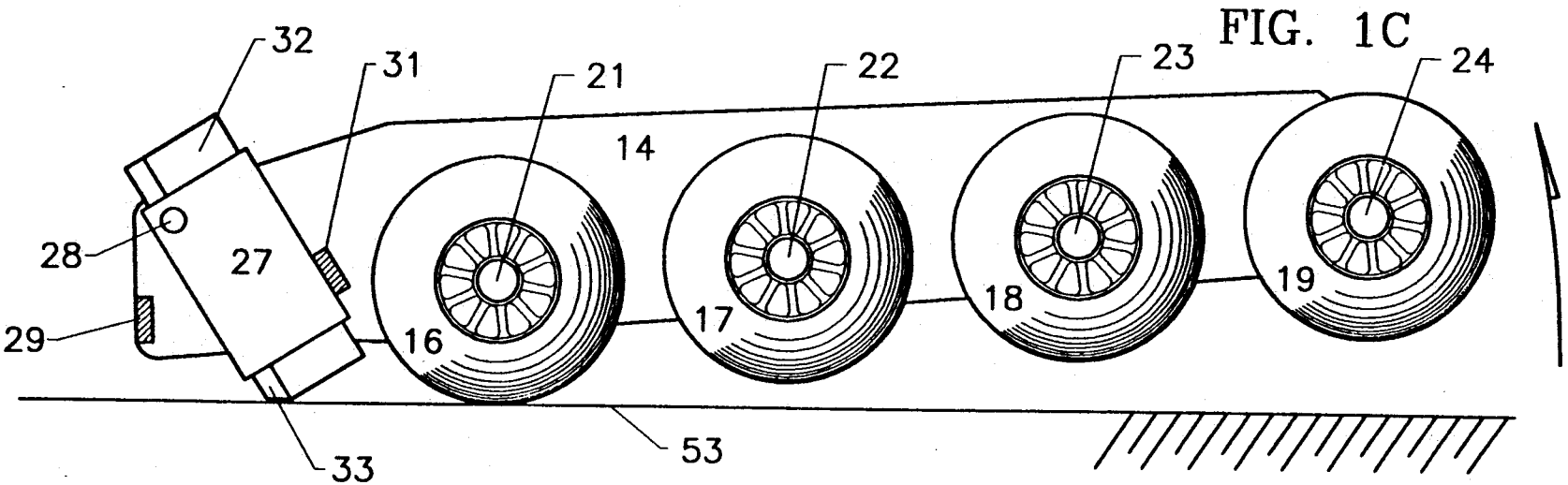
FIG. 1C is a side view of the wheel rack portion of FIG. 1A in the activation state.
Figure 1D:
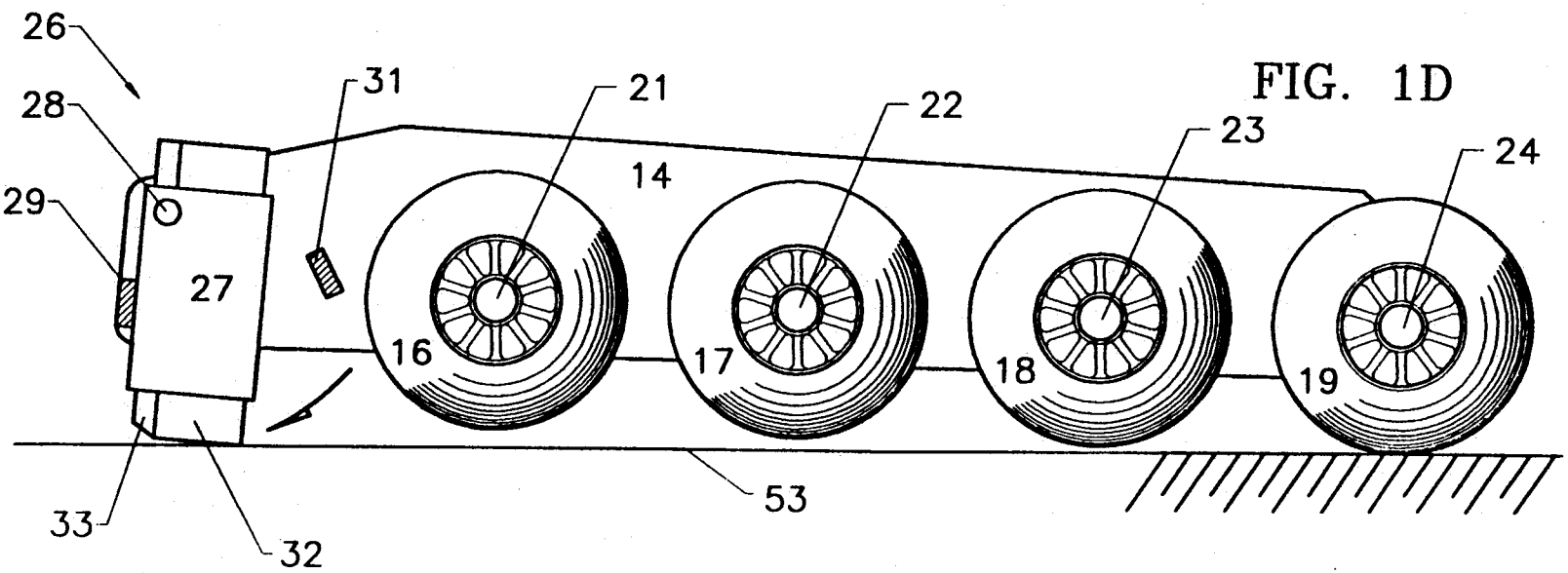
FIG. 1D is a side view as in FIG. 1C, but in the deployed state.

To illustrate how the brake is activated and then continuously applied so long as braking is desired, FIGS. 1C and 1D show a portion of the skate in side view in the stowed state and the braking state, respectively. FIG. 1C shows the toe being raised as shown by the arrow, and activation surface 33 is nearly touching the road surface 53. When it does touch, assembly 27 will rotate about pivot 28 from stop bar 31 to stop bar 29, to the position shown in FIG. 1D. In the braking state of FIG. 1D, only wheel 19 and friction surface 32 touch road surface 53. The skater's weight is between these two points, giving stability to his forward movement. In contrast, prior art brakes require the application of force solely to a point behind the wheel rack, resulting in instability.

It will be clear from FIG. 1D that braking will continue as long as the skater applies weight to the brake assembly 27, with no need for squeezing, as in a bicycle brake, or other application of muscular force to the activation means, as in raising the toe with conventional in-line skate brakes.

Referring again to FIG. 1C, the angle between the line along the bottom of wheels 16–19 and the line of road surface 53, should be between 5–20 degrees in order to conveniently trigger braking by contacting activation surface 33 to road surface 53.

Figure 2A:
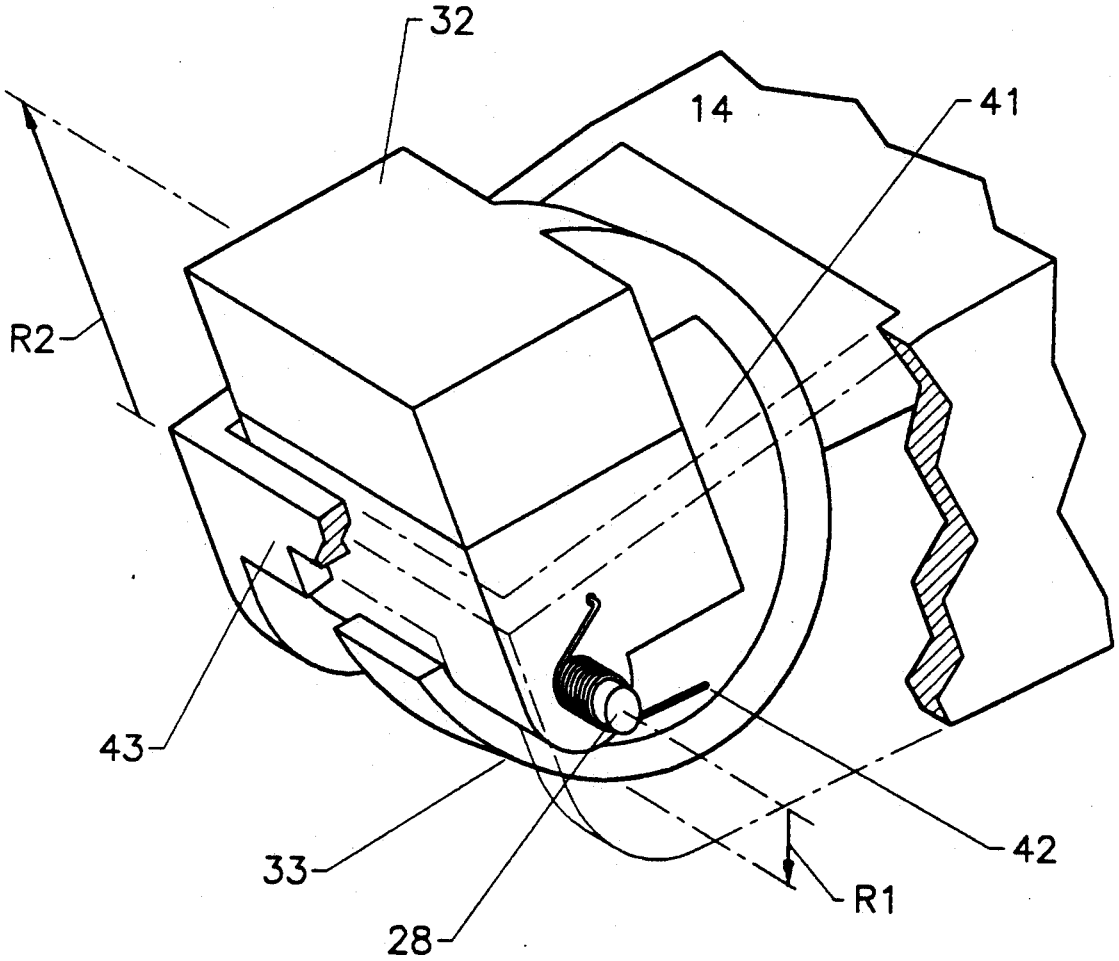
FIG. 2A is an isometric view of a portion of the "cam" embodiment.

FIG. 2A illustrates the eccentric embodiment where a cam surface 41 is rotatably mounted on pivot 28. The follower for the cam surface 41 is the surface being traversed. Friction surface 32 is bonded to cam surface 41 where the braking is at a maximum, and activation surface 33 is bonded to cam surface 41 where it is nearest the road when in the stowed position.

In the normal stowed position shown in FIG. 2A, torsion spring 42 holds cam surface 41 against stop 43. Pivot 28 is mounted on wheel rack 14 (not shown) in the same manner as in FIG. 1A aft of the rearmost wheel. Radius R1 is shorter than the distance from the point where pivot 28 is mounted to the ground, so that when stowed there is no contact between cam surface 41 and the surface being traversed.

To engage the brake assembly of FIG. 2A, the skater lifts his toe so that activation surface 33 touches the road surface, causing cam surface 41 to rotate in a clockwise direction around pivot 28 towards the greater radius R2. This rotation of the cam causes the skate to ride up on brake surface 32 and the front wheel 19 (FIG. 1D). Braking surface 32 is bonded to cam surface 41 from the point in the arc where cam 41 touches the ground to the end of the cam, allowing braking at all points of the arc where contact with the surface is made. As with the embodiment of FIGS. 1C and D, activation surface 33 is a material best serving as a trigger, while friction block 32 is a material capable of bearing heavy frictional forces.

Figure 2B:
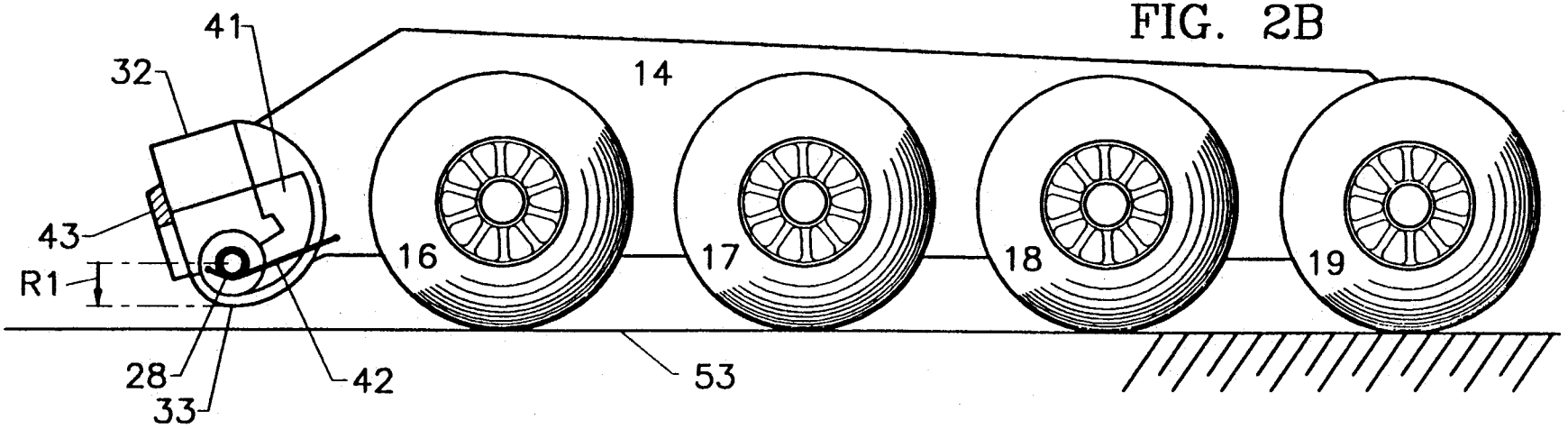
FIG. 2B is a side view of the brake and wheel portion of the skate of FIG. 2A in the stowed position.
Figure 2C:
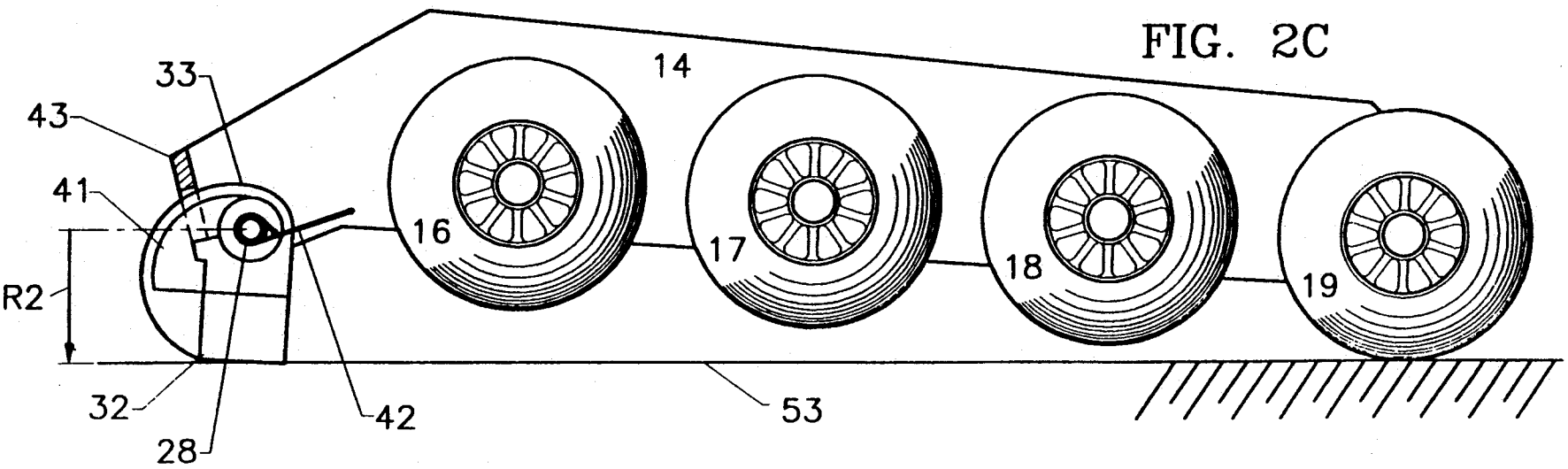
FIG. 2C is a side view of the assembly of FIG. 2B, but in the braking position.

FIGS. 2B and 2C illustrate a portion of the skate with the brake in the stowed position and the braking position, respectively In FIG. 2B, spring 42 holds cam 41 against stop 43, with activation surface 33 nearest the road surface 53. In order to initiate braking, the skater raises his toe sufficiently to touch surface 33 against road surface 53, typically an angle of 5–20 degrees. Once contact is made, cam 41 rotates clockwise to the position shown in FIG. 2C. In the braking state, road surface 53 continuously abrades the surface 32, while wheel 19, the only other contact between the skate and the surface 53, rolls with the skater's forward momentum. When braking has sufficiently slowed the forward momentum, the skater simply raises his heel sufficiently to disengage braking surface 32 from the road surface 53, at which point spring 42 rotates the cam 41 about pivot 28 until it rests against stop 43, the position shown in FIG. 2B.

The embodiment of FIGS. 2A and 2C provides a somewhat smoother deployment than the embodiment of FIGS. 1A-D because of the arcuate surface of cam surface 41.

Figure 3A:
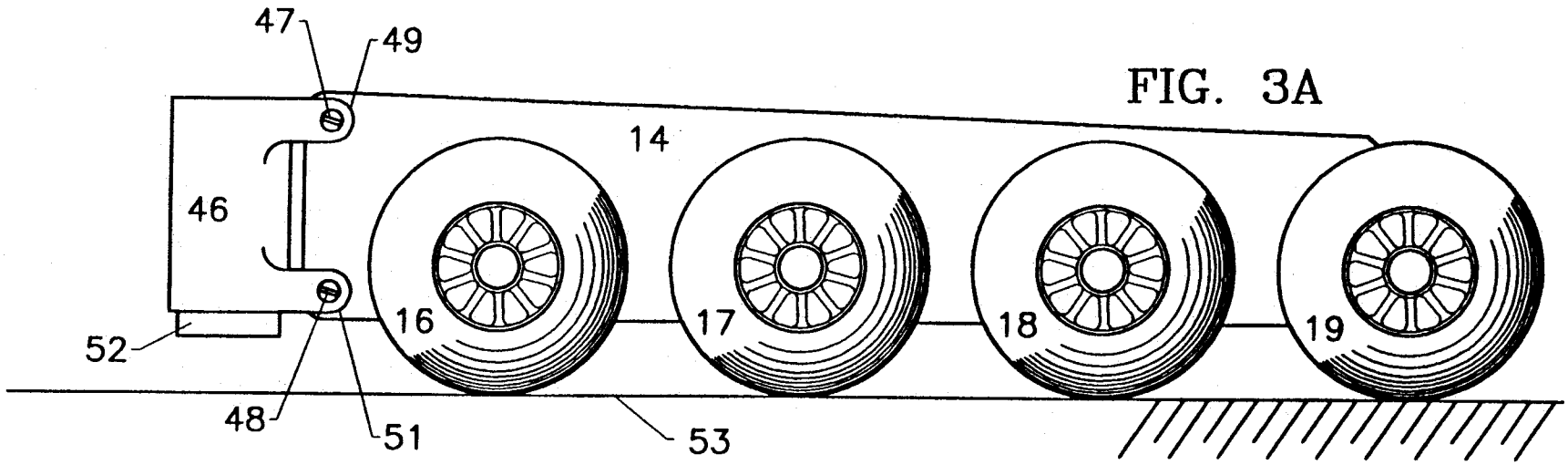
FIG. 3A is a side view of a skate with the "plunger" embodiment in the stowed condition.

FIG. 3A is a side view of a skate 11 with a plunger embodiment of the invention in the stowed position. Plunger 46 is attached to the back end of the wheel rack 14 by bolts 47 and 48 which pass through ears 49 and 51, respectively, on each half of the housing for plunger 46 as well as through wheel rack 14. Nuts (not shown) on bolts 47 and 48 secure both halves of the plunger housing to the wheel rack 14. Friction pad 52 extends slightly from plunger 46 in the stowed position of FIG. 3A.

Figure 3B:
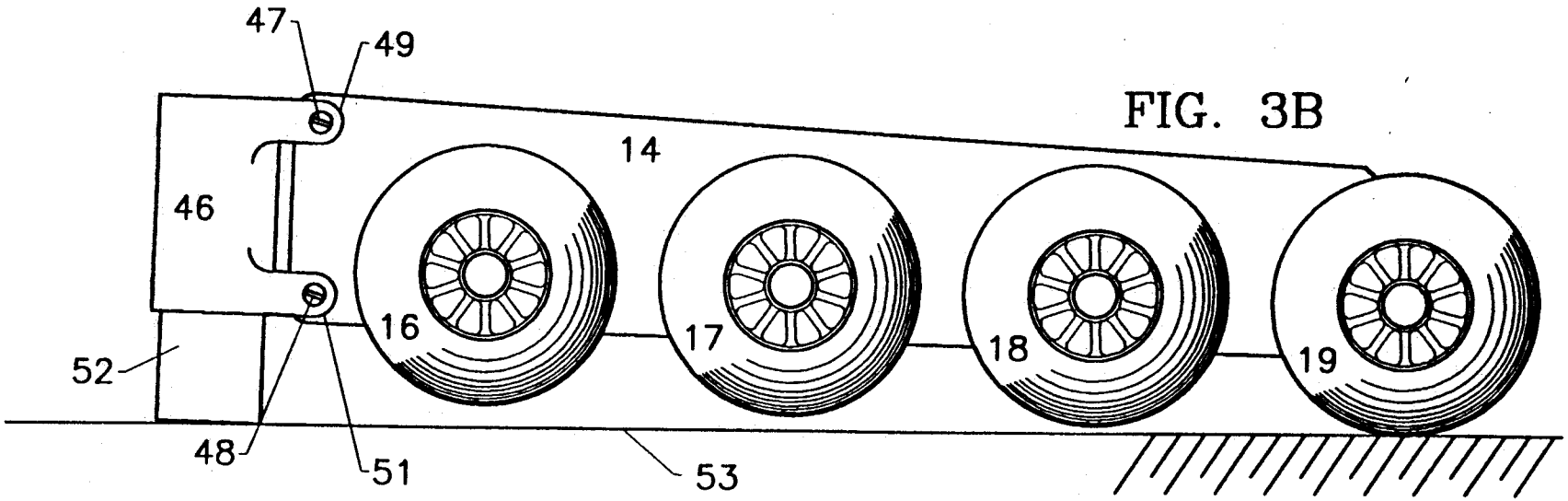
FIG. 3B is a side view of the skate of FIG. 3A in the deployed condition.

FIG. 3B is the same skate as in FIG. 3A, but with the plunger 46 deployed so the friction pad 52 is in contact with the contact plane 53. As with the previously described embodiments, when the brake is deployed in FIG. 3B, friction pad 52 engages contact plane 53, raising wheels 16, 17 and 18 above contact plane 53. Only the forwardmost wheel 19 continues to roll on surface 53. A substantial portion of the skater's body weight may be brought to bear on pad 52 engaging surface 53 to slow forward velocity.

Figure 4:
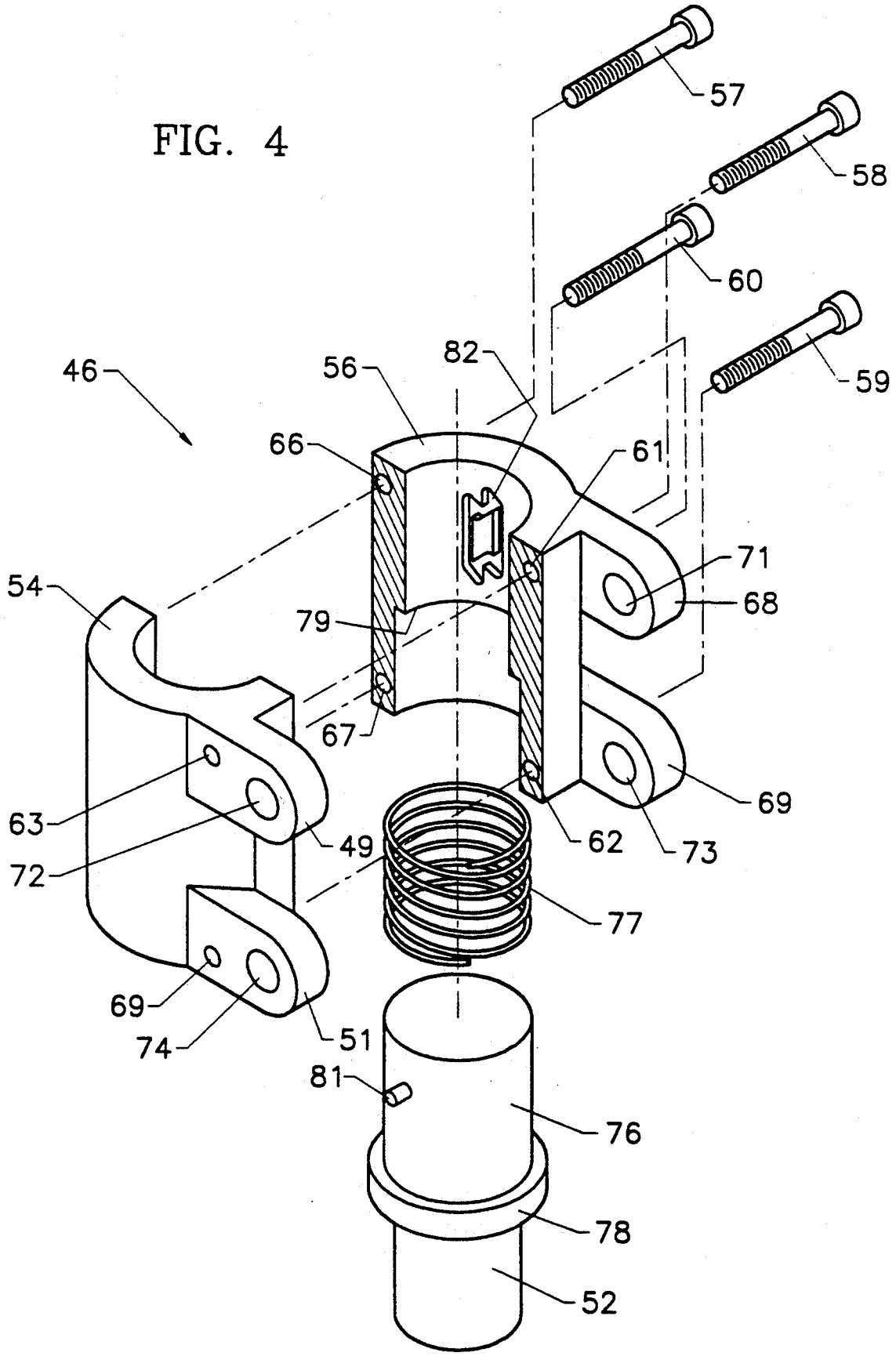
FIG. 4 is an exploded isometric view of a portion of the plunger assembly of FIG. 3.

FIG. 4 is an exploded isometric view of the plunger 46 of FIGS. 3A and 3B. Plunger 46 consists of a housing having two halves 54 and 56 secured together by four bolts 57-60 and nuts (not shown). Bolts 58 and 59 pass through housing half 56 at holes 61 and 62 and housing 54 at holes 63 and 69. Nuts (not shown) are threaded to bolts 58 and 59 to secure the housing at the near side. Similar fastening at the far side is accomplished by nuts and bolts, which are shown at 57 and 60, which pass through hole 66 in half 56 and a cooperating hole (not shown) in half 54. The fourth bolt 60 passes through hole 67 to provide four points of attachment of halves 54 and 56. As shown in FIG. 4, ears 49 and 51 on half 54 of plunger 46 fit the skater's right side of the wheel rack, while ears 68 and 69 fit the left side. Bolts 47 and 48 (FIG. 3) pass through holes 71 and 72, and 73 and 74, respectively, as shown in FIG. 4, the bolts also pass through wheel rack 14 to grasp it between housing halves 54 and 56.

Within housing 54 and 56 there is a spring-urged friction block 52 held in block holder 76. A compression spring 77 encompasses block holder 76, resting at the bottom on spring shoulder 78 in block holder 76 and at the top engaging spring shoulder 79 in housing 56. Housing half 54 has a corresponding shoulder like the one shown at 79.

Each side of block holder 76 has protruding from it a pin or cam follower 81, one of which is shown in FIG. 4. Each housing half also has formed into it a track or cam surface 82 for guiding pin 81 on holder 76.

Figure 5:
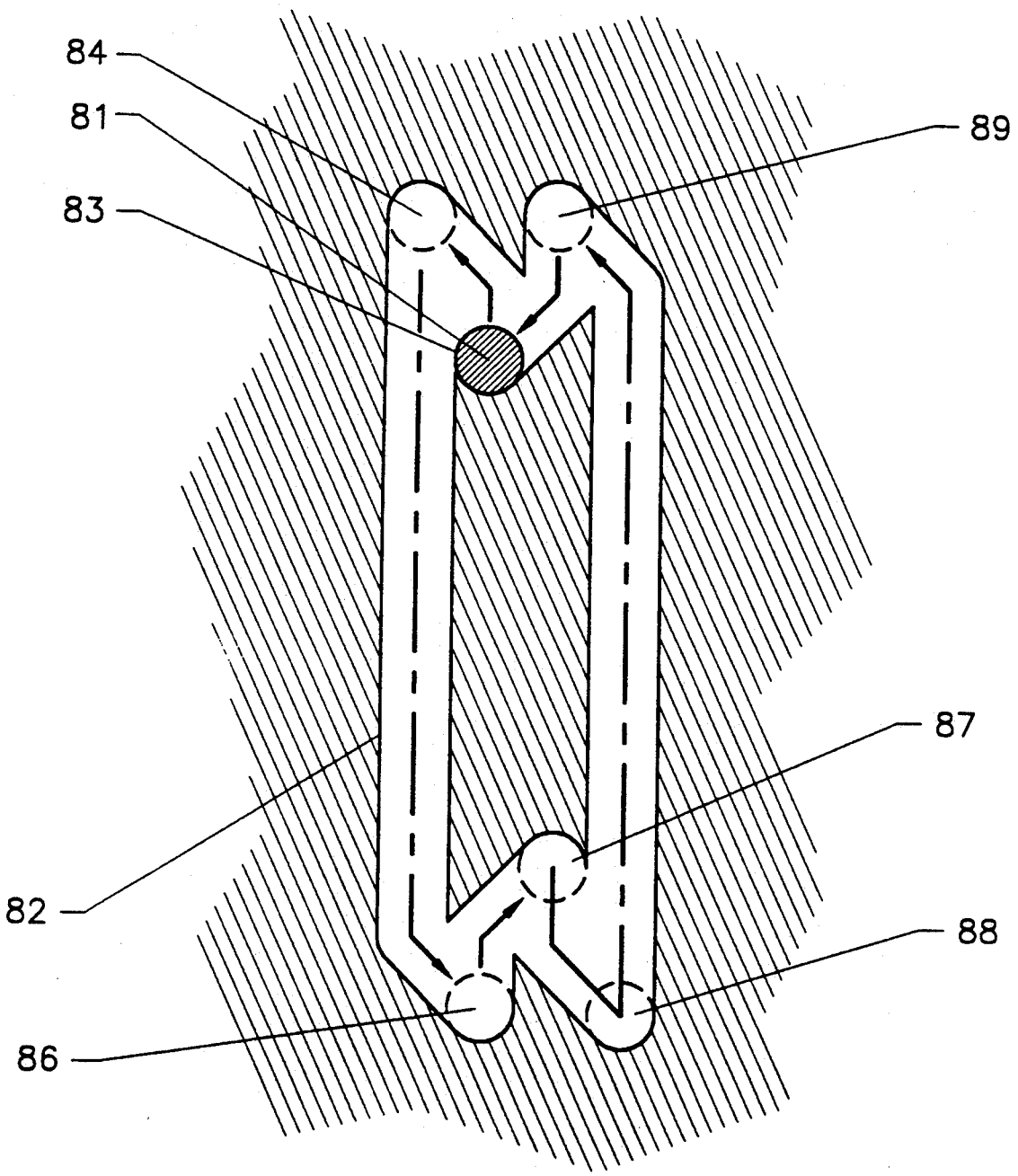
FIG. 5 is a side view of the raceway followed by the pin or cam follower in the plunger embodiment of FIG. 4.

FIG. 5 is a detail of the cam and cam follower of the side of block holder 76 and housing 56 of FIG. 4. Track 82 on the side of housing 56 permits the pin 81 to move between various stations whereby the brake proceeds from stowed state to deployed state and back again. Thus, as shown in FIG. 5 pin 81 in solid lines is at the stowed position 83, where it is secure from dislodgement in normal operation. When the skater raises his toe sufficiently to engage the activation surface 33 against the road 53 (FIG. 1C), the pin 81 moves to station 84 in FIG. 5, which is the release station at which the force of the spring holding the brake assembly in the stowed position is overcome, and the plunger moves downwardly to contact the road surface. Station 86 is the fully extended position. The pin then lodges in the braking position 87 where the pin is more securely held than at other positions; comparable to the stowed position 83.

Once the forward speed has been slowed sufficiently, the skater lifts his heel so that the friction surface 32 no longer contacts road 53. This releases pin 81 from the position at 87 into return station 88, at which point it may be moved back into the stowed position. By tapping pad 52 against road surface 53, to move, the plunger retracts as pin 81 moves to station 89, before resting in the original stowed position shown in solid lines in FIG. 5.

Figure 6:
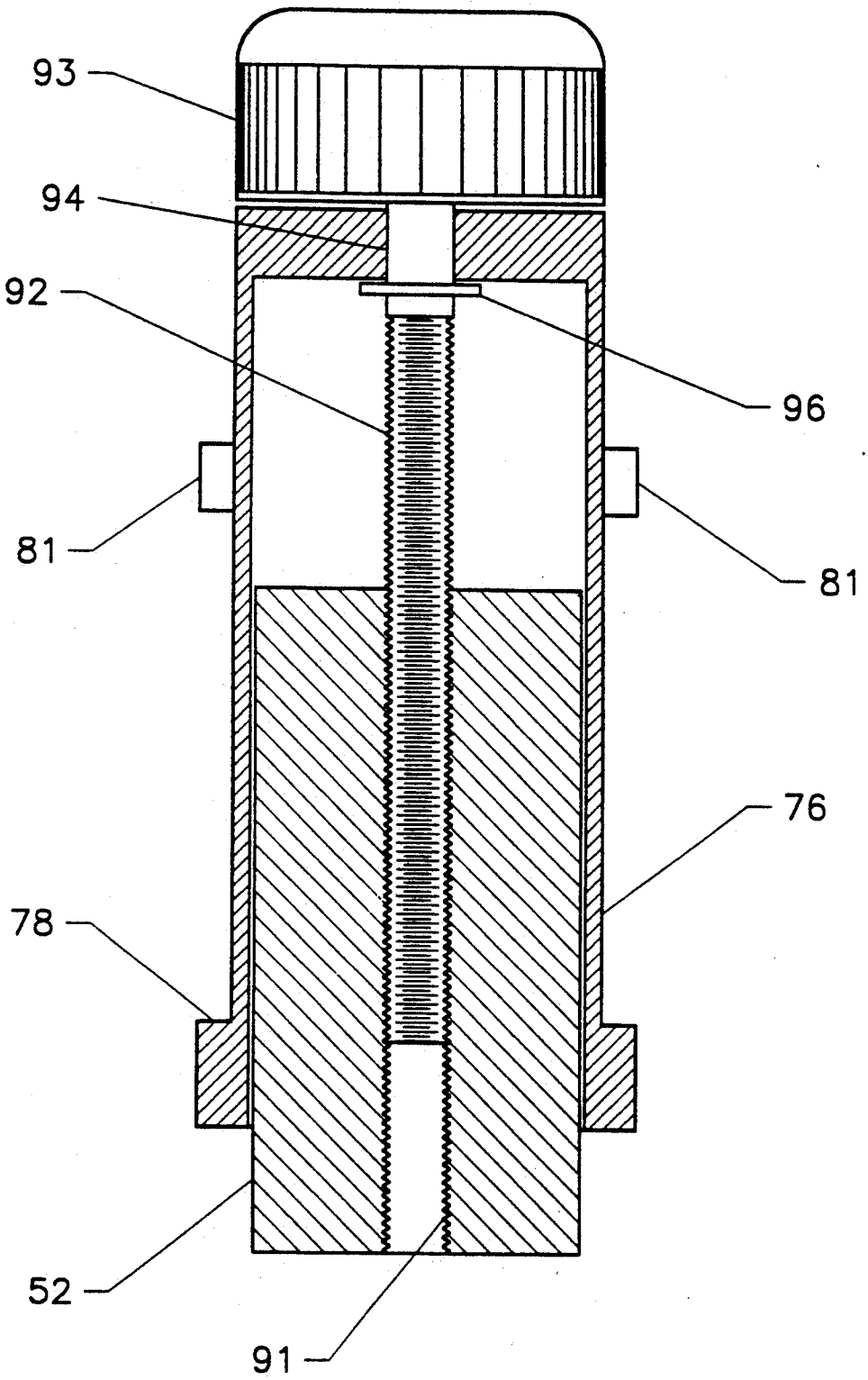
FIG. 6 is a side view, partially in section, of the plunger adjustment for extending the wear surface.

FIG. 6 is the plunger of FIG. 4, partially in section, showing friction block 52 being adjustable to accommodate wear. Block holder 76 encompasses friction block 52 which has a central threaded passage 91 bored longitudinally. A correspondingly threaded shaft 92 is inserted in passage 91, and the combined shaft and block permit ready extension and retraction of the friction surface as needed for effective braking. Adjustment of block 52 in relation to holder 76 is made by turning knob 93 secured to the unthreaded end of shaft 92, passing through block 52 at hole 94. Shaft 92 is kept in place by shaft keeper 96.

Figure 7A:
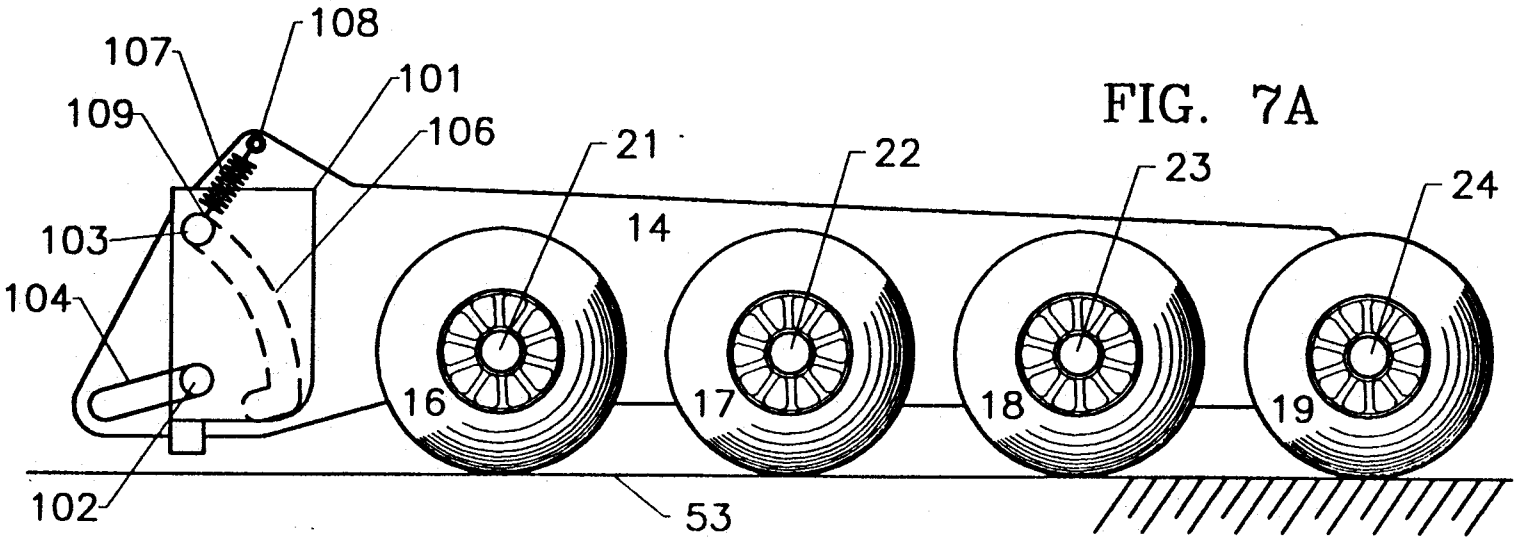
FIG. 7A is a partial side view of a skate illustrating the "cam follower" embodiment in the stowed position.
Figure 7B:
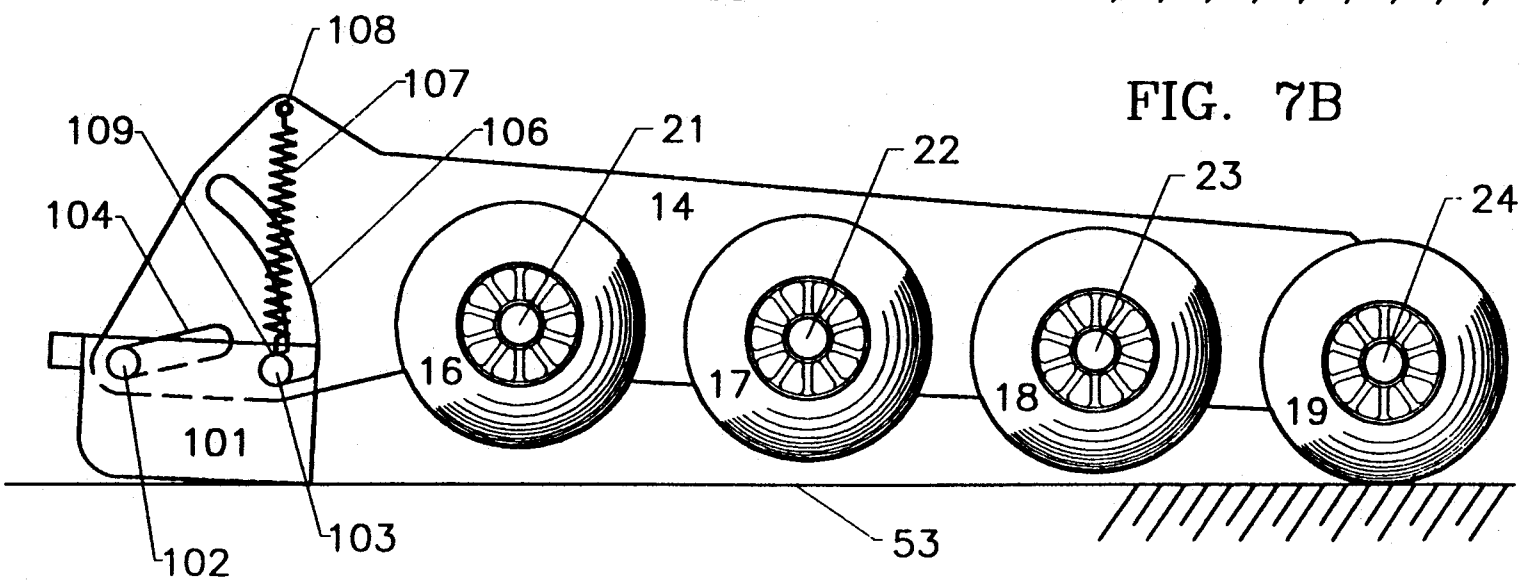
FIG. 7B is the same view as is FIG. 7A, but in the deployed position.

FIGS. 7A and 7B shows a variation of the pin and track, or cam and cam follower embodiment of FIGS. 4 and 5. In FIGS. 7A and 7B, a larger friction block 101 allows for more efficient braking as well as longer brake life because of greater contact area with plane 53. Block 101 is mounted on wheel rack 14 by pins 102 and 103, which serve as cam followers for following the surface of tracks 104 and 106, respectively, which are openings in wheel rack 14, pins 102 and 103 move between the stowed condition, shown on FIG. 7A, and the deployed condition shown in FIG. 7B. Spring 107, secured to wheel rack 14 at 108, and to pin 103 at 109, keeps block 101 in the stowed position until braking is desired. As before, the skater raises his toe to touch block 101 against contact plane 53, and pins 102 and 103 move down tracks 104 and 106 from the position shown in FIG. 7A to that shown in FIG. 7B. When deployed, wheels 16, 17 and 18, mounted on shafts 21, 22 and 23 to wheel rack 14, are off the ground, with only the forward wheel 19 and block 101 in contact with the ground 53.

It will be apparent that another variant on the cam and cam follower principle is a rack and pinion (not shown). The teeth in a rack and pinion allow the force of the skater's weight to be counteracted by the frictional drag of the mechanism, in contrast to the rolling relationship between cams 104 and 106 and cam followers 102 and 103.

Figure 8A:
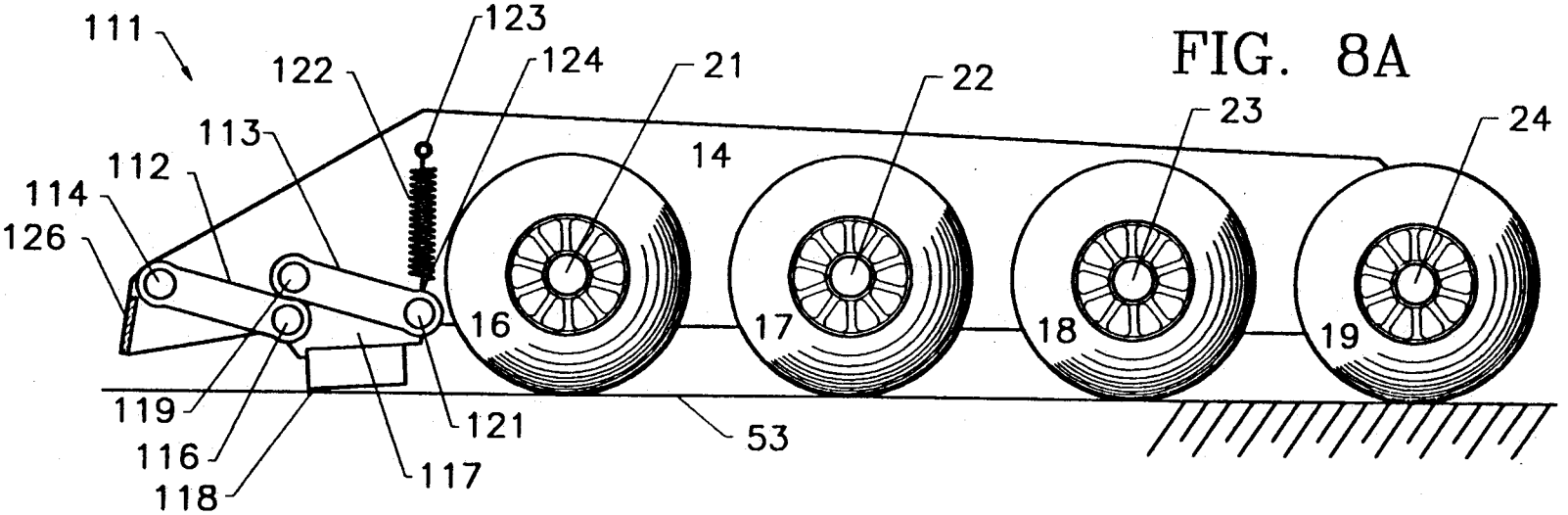
FIG. 8A is a side view of a portion of a skate illustrating the "four-bar linkage" embodiment in the stowed conditions.
Figure 8B:
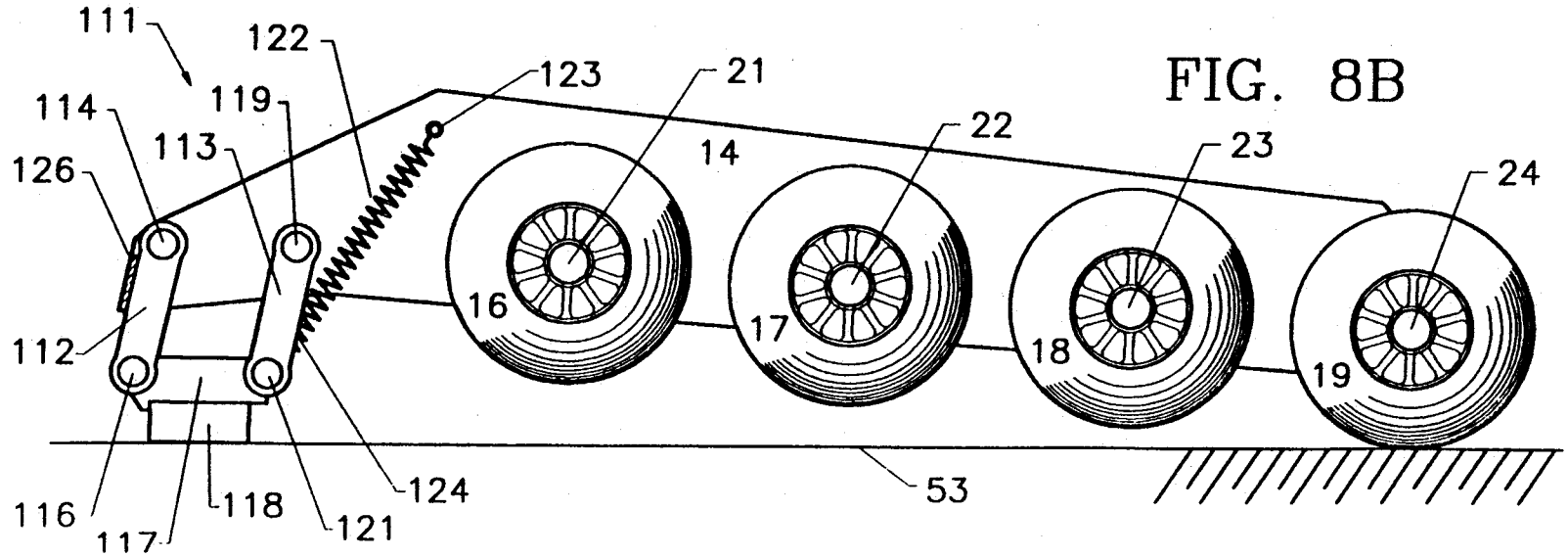
FIG. 8B is the same view as in FIG. 8A in the deployed condition.

FIG. 8 illustrates a side view of an in-line skate with a brake using a four-bar linkage 111. FIG. 8A shows the linkage in the stowed position, and FIG. 8B shows it in the deployed position. Links 112 and 113 are pivotable about pins at each end for efficient movement between the two positions.

Link 112 is fastened to wheel rack 14 by pin 114. Pin 116 at the other end connects link 112 to friction block carrier 117, which holds friction block 118. The other link 113 is likewise fastened to wheel rack 14 by pin 119, and to carrier 117 by pin 121.

The brake assembly 111 is held in the stowed position in FIG. 8A by spring 122, which is attached to wheel rack 14 at 123 and to carrier 117 at 124. When the skater desires to brake, he raises his toe to allow friction pad 118 to touch contact plane 53. This causes the four-bar linkage to drop to the deployed position of FIG. 8B, where wheels 16, 17, and 18 are off the ground, and wheel 19 and pad 118 are the only contacts between the skate and plane 53. The amount of braking can be controlled by the amount of the skater's body weight applied to the friction pad 118. Link 111 is limited by stop 126 to keep links 111 and 112 slightly beyond the vertical position to lock the brake in the deployed state while the skater is standing on the brake assembly. When braking is complete, the skater lifts his heel, and spring 122 retracts the brake 111 to its stowed position shown in FIG. 8A.

Figure 9:
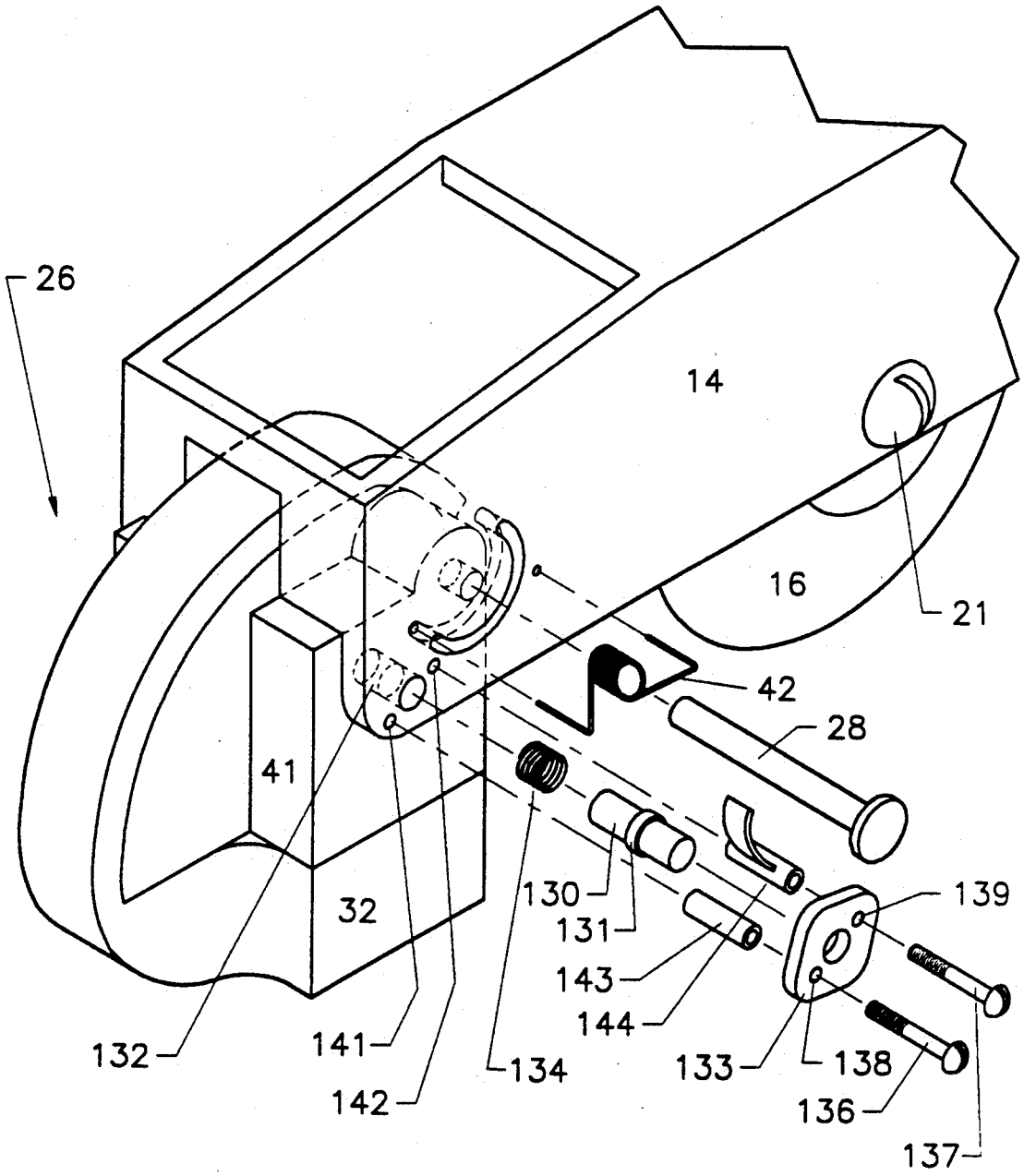
FIG. 9 is an isometric view, partially exploded and partially in phantom, showing the locking feature of the braking system.

FIG. 9 is an isometric view of a brake locking device to lock the brake in the deployed state. If the brake is deployed and locked in the deployed state, the skater can walk up or down stairs, traverse surfaces without rolling, and otherwise maneuver in a stable, albeit awkward, mode with the skates on. Like ski boots, it is desirable to be able to move about with the skates or boots on, even though it is not particularly easy.

FIG. 9 shows a push button 130 that engages hole 132 in cam surface 41 to prevent brake 27 from being moved to the stowed position Push button 130 engages hole 132 to lock the assembly in the braking position so that the skater has only two contact points with stairs or other surfaces: the front wheel (not shown) and friction surface 32. Push button 130 is movable between the locked state, where the push button 130 is in hole 132, and the released state, where the push button 130 is out of hole 132 and is pressed against releasing plate 133 by return spring 134. Spring 134 tends to force past button 130 to the right in FIG. 9, against retaining place 133. Push button 130 has a ridge 131 on its circumference to keep it from passing through plate 133. Returning plate 133 is held in place by screws 136 and 137, which pass through holes 138 and 139, respectively, in plate 133. The screws 136 and 137 are secured in holes 141 and 142, respectively, by wheel rack 14. Screw 136 also passes through spacer 143 between plate 133 and rack 14, which allows the push button 132 to move between its locked and released positions. Screw 137 also passes through position locking spring 144, which serves not only as a spacer corresponding to spacer 143, but also as a means to retain the push button 130 in its locked position.

In order to lock the brake, the skater deploys the brake by raising the toe of his skate to engage cam 41 and rotate it about pivot 28 to the deployed position shown in FIG. 9 with friction surface 32 against the road surface. The skater pushes past button 130 inwardly (to the left in FIG. 9) to insert it by hole 132, position locking spring 144 holds the push button 130 in the hole 132, thereby preventing cam 41 from rotating about pivot 28.

In order to release the lock, the skater puts weight on his heel to rotate cam 41 in a counter clockwise manner sufficiently to exceed the holding strength of position locking spring 144. Once push button 130 is released from spring 144, it moves to the right in FIG. 9 by return spring 134 into the r®leased state, whereby the push button 130 is retracted from hole 132 and rests against retainer plate 133 by spring 134.

Normal coasting motions are to stand erect over the wheels while the wheels roll in a forward direction. It is the intent of the present invention to follow the normal coasting motions while slowing forward momentum. This is accomplished by moving the brake to break the plane of the surface being traversed so that the friction pad engages the road surface. Once deployed, the skater simply remains erect over his skates, and his forward progress is slowed, without the need for awkward or uncomfortable skating maneuvers. Once the brake is activated, no further force on the activator is needed, and the force of gravity on the skater, transmitted to the deployed friction pad, serves to brake.

In each of the foregoing embodiments, it is preferable that the friction block and its activation surface be kept from accidental contact with the ground when braking is not desired. For example, when the skater leans into a turn, the wheels ride well over on their sides, and a wide friction block might accidentally touch the contact plane. Two safety features should be kept in mind in practicing the invention. First, the line between the lowermost point of the friction block or the activation surface and the lowermost tangent of the rear wheel should be at an angle of at least five degrees to the surface being traversed up to 20 degrees. Thus, if the brake is 5 degrees or more above the road, accidental deployment can generally be avoided. Second, the activation surface or friction block should not extend laterally beyond the side of the rear wheel(s). On an in-line skate, this means that the initial contact point for the brake should be narrower than the rear wheel. Thus, even if the skater leans drastically, the brake will not be accidentally deployed.

While the foregoing embodiments show movement of the brake in relation to the skate, it will be apparent that the skater may be moved in relation to the brake, so long as the braking surface penetrates the plane of the wheel bottoms Other embodiments of the invention will be apparent to those having skill in the art for lowering a braking means below the normal skating plane formed by the wheels.

We claim:

1. In a brake for a roller device bound to a skater's foot for skating on a surface, said device having at least one wheel forward of an aft wheel, the improvement comprising a friction means movable in relation to the plane of the lowermost points of said wheels between a stowed position above said plane and a braking position below said plane, means for deploying the friction means relative to the plane from the stowed position into the braking position, and return means for moving the friction means relative to the plane into the stowed position.

2. A brake as in claim 1 wherein the means for returning the friction means from the deployed position to the stowed position is a spring.

3. A brake as in claim 1 wherein the means for deploying comprises a lever pivotable about a fulcrum and bearing the friction means, said lever moving the friction means between the stowed position and the deployed position as the lever pivots, and stop means limiting the rotation of the lever about the pivot to a stowed position and a deployed position.

4. A brake as in claim I wherein the means for deploying comprises a cam surface mounted on a pivot to rotate between a stowed position and a deployed position, and stop means defining the two positions.

5. A brake as in claim 1 wherein the friction means comprises a housing and a pad that is adjustably mounted in said housing to permit extension or retraction of the friction pad to accommodate wear of the pad.

6. A brake as in claim 1 wherein the means for deploying comprises a plunger mounted aft of the rearmost wheel of the skate, said plunger having a housing containing a friction pad movable in a substantially vertical plane between a stowed position and a deployed position.

7. A brake as in claim 1 wherein the means for deploying comprises a four bar linkage to move the friction means between a stowed position and a deployed position.

8. In a brake for a roller device bound to a skater's foot for skating on a surface, said device having at least one wheel forward of an aft wheel, the improvement comprising (1) means for activating the brake to engage the surface being traversed by the roller device below the plane of the lowermost points of said wheels and (2) means for continuously applying braking force and (3) means for stowing the brake when braking is not needed, whereby the means for application of braking force is independent of the means for activating and the means for stowing.

9. A brake as in claim 1 having means to lock the friction means in a deployed state relative to the plane, whereby the skater can walk on the friction pad and front wheel of the skate rather than roll on the wheels.

10. A brake as in claim 1 wherein the wheels are in a wheel rack and the wheel rack is pivoted about a point toward the toe of the skate between a skating mode and a braking mode, and the wheel rack is moved relative to the friction means.

11. A brake means for a roller device having at least two wheels comprising (1) a friction means having a stowed position and a deployed position below the plane of the lowermost points of said wheels (2) activation means and (3) stowing means for moving the brake means from the deployed position to the stowed position, whereby the friction means once deployed remains in its deployed position without further additional activation effort until released from the deployed position.

12. In a method of braking a roller device bound to a skater's foot for skating on a surface, the device having at least one wheel forward of an aft wheel, and the skater being propelled forward on the wheels, the improvement comprising (1) moving a friction means from a stowed position relatively higher than the plane of the lowermost points of the wheels to a deployed position relatively lower than said plane, whereby the device is supported in part by the friction means; (2) applying at least some of the skaters body weight to the friction means to slow the forward movement of the skater; and (3) restoring the friction means to a stowed position above the plane when sufficient slowing has taken place.

13. In a method as in claim 12 wherein substantially all of the skater's body weight is applied to the friction means.

14. In a method as in claim 12 wherein the friction means is lowered relative to the device by the skater raising the toe of the skate, while leaving the aft wheel in contact with the surface being traversed, sufficiently to touch the friction means to the surface and cause it to be deployed.

15. In a method as in claim 12 wherein the friction means is restored to its stowed position by lifting the portion of the skate near the friction means sufficiently to release the friction means from contact with the surface being traversed, and applying a force to the friction means to return it to its stowed position 16. In a method as in claim 12 wherein braking is activated by lowering the friction means to initiate a bracking cycle and once activated, no further force beyond friction against the road surface need be applied to maintain the braking state.

17. In a method as in claim 12 wherein braking is facilitated by pivoting on the front wheel while force is applied to the friction means, thereby augmenting the braking function with a turning function.

18. In a method as in claim 12 wherein the weight of the skater is applied through the ankle to the skate at a point between the front wheel and brake pad, whereby braking load is borne primarily by the upper leg rather than the lower leg of the skater.

19. A method of braking a roller device having at least two wheels bound to a skater's foot for skating on a surface comprising (1) applying a force to activate a bracking cycle, (2) applying a bracking force and sustained by normal coasting motions, against a friction surface so that the brake is below the plane of the lowermost points of said wheels to slow the forward momentum of the skater, (3) releasing the braking force when the forward momentum has slowed to the desired extent, and (4) stowing the brake.

* * * * *

UNITED STATES PATENT AND TRADEMARK OFFICE

CERTIFICATE OF CORRECTION

PATENT NO. : 5,299,815

DATED : April 5, 1994

INVENTOR(S) : Brosnan et al.

It is certified that error appears in the above-identified patent and that said Letters Patent is hereby corrected as shown below:

In claim 19, line 4 (col. 16, line 39), delete "bracking force" and replace with --braking force, independent of the activating force--.

Signed and Sealed this

Fifteenth Day of June, 1999

*Attest:*

Q. TODD DICKINSON

*Attesting Officer*

*Acting Commissioner of Patents and Trademarks*